United States Patent [19]

Oliver et al.

[11] 4,029,481

[45] June 14, 1977

[54] SELF POWERED BLUE WATER GAS GENERATOR

[75] Inventors: Stuart M. Oliver, Los Angeles; Sanford J. Parsons, Richmond, both of Calif.

[73] Assignee: Q² Corporation, Saratoga, Calif.

[22] Filed: Mar. 3, 1975

[21] Appl. No.: 554,761

[52] U.S. Cl. ..... 48/111; 48/73; 48/99; 48/123

[51] Int. Cl.² ..... C10J 3/20

[58] Field of Search ..... 48/61, 62 R, 73, 77, 48/89, 99, 101, 108, 111, 113, 123, 202; 122/5; 110/31, 11; 202/127

[56] References Cited

UNITED STATES PATENTS

| | | | |
|---|---|---|---|
| 447,506 | 3/1891 | DeMill | 48/123 |
| 1,278,180 | 9/1918 | McDonald | 48/123 |
| 1,461,614 | 7/1923 | Harrison | 48/111 |
| 1,495,776 | 5/1924 | Burdick | 48/62 A |
| 1,587,588 | 6/1926 | Kaemmerling et al. | 48/202 |
| 2,094,946 | 10/1937 | Hubmann | 48/202 |
| 2,203,137 | 6/1940 | Freeman | 48/108 |
| 2,834,665 | 5/1958 | Rudolph et al. | 48/62 R |
| 3,875,077 | 4/1975 | Sanga | 202/127 |
| 3,890,111 | 6/1975 | Knudsen | 48/202 |

*Primary Examiner*—S. Leon Bashore
*Assistant Examiner*—Peter F. Kratz
*Attorney, Agent, or Firm*—Theodore Scott Park

[57] ABSTRACT

A self powered blue water gas generator includes a sealed retort forming a vertical column and having an input air lock coupled to receive carbonaceous material and a lower output air lock. The column includes a grate positioned within the column and disposed to receive impinging carbonaceous material passed through the input air lock. The grate and column are heated through conduction by burners communicating with the interior of the column and positioned outside and below the column to establish a vertical temperature gradient therewithin. Blue water gas produced within the column by carbonaceous material refluxing within the column fuels the burners and is extracted for utilization by a pipe communicating with the interior of the column. A steam pipe is positioned beneath the grate and within the column for producing steam beneath the grate.

After initial fire up the generator is self-powered by its own product and produces blue water gas having an increased CO yield with decreased $CO_2$ production.

6 Claims, 3 Drawing Figures

SELF POWERED BLUE WATER GAS GENERATOR

BACKGROUND AND SUMMARY

The field of art to which the invention pertains is the gas generating art. Water gas generators are typically powered by a fuel or by materials containing thermal energy such as steam, heated coal or hot gasses. Internal combustion processes requiring oxygen feeding are employed wherein a fuel such as, for example, coal or the like is burned within a forced air fed retort. Such processes produce undesirable amounts of carbon dioxide for many catalytic processes requiring water gas. In addition, most prior generators are batch fed generators and are incapable of continuous feeding and continuous emptying without interrupting gas generation. The invention is a self powered continuous feeding and continuous emptying gas generator producing blue water gas by refluxing carbonaceous waste materials. An externally heated reflux chamber formed by a sealed retort forming a vertical column is heated to a temperature of approximately 1200° C and carbonaceous materials are placed within the chamber. A portion of the carbonaceous material vaporizes and the remainder is oxidized into carbon monoxide. Sufficient water is injected as steam beneath the heated grate zone to provide sufficient hydrogen and oxygen to bring the reaction to completion. Remaining carbonaceous materials and gasses reflux and impinge the heated grate zone where the reaction conditions produce carbon monoxide and hydrogen as the predominant species. More complex compounds are reduced to this state via a plurality of heating and reflux cycles. Oxygen separates from hydrogen of the steam molecules and combines with the carbon when the hot carbonaceous material is impinged by the steam thereby producing carbon monoxide and hydrogen gas. A portion of the water gas so produced is utilized to maintain the operating temperature of the reflux chamber by being burned outside of the reflux chamber and the remaining water gas is available for utilization for heating, lighting, or catalysis to other compounds. There is no requirement to oxygen feed the reflux chamber since required heat is provided by burning the gas produced outside the reflux chamber and because a reflux process is utilized instead of internally combusting the carbonaceous material. $O_2$ input is undesirable due to the $C0_2$ produced thereby. Carbon monoxide and hydrogen gas yield is enhanced with respect to carbon dioxide production as a result. In addition, total gas yield is improved from approximately 40% in the prior art to 95% with the invention. Dangerous carbon monoxide gas produced by the generator is either contained within the sealed reflux chamber, utilized, or burned.

DESCRIPTION OF THE PREFERRED EMBODIMENT

Figure 1:
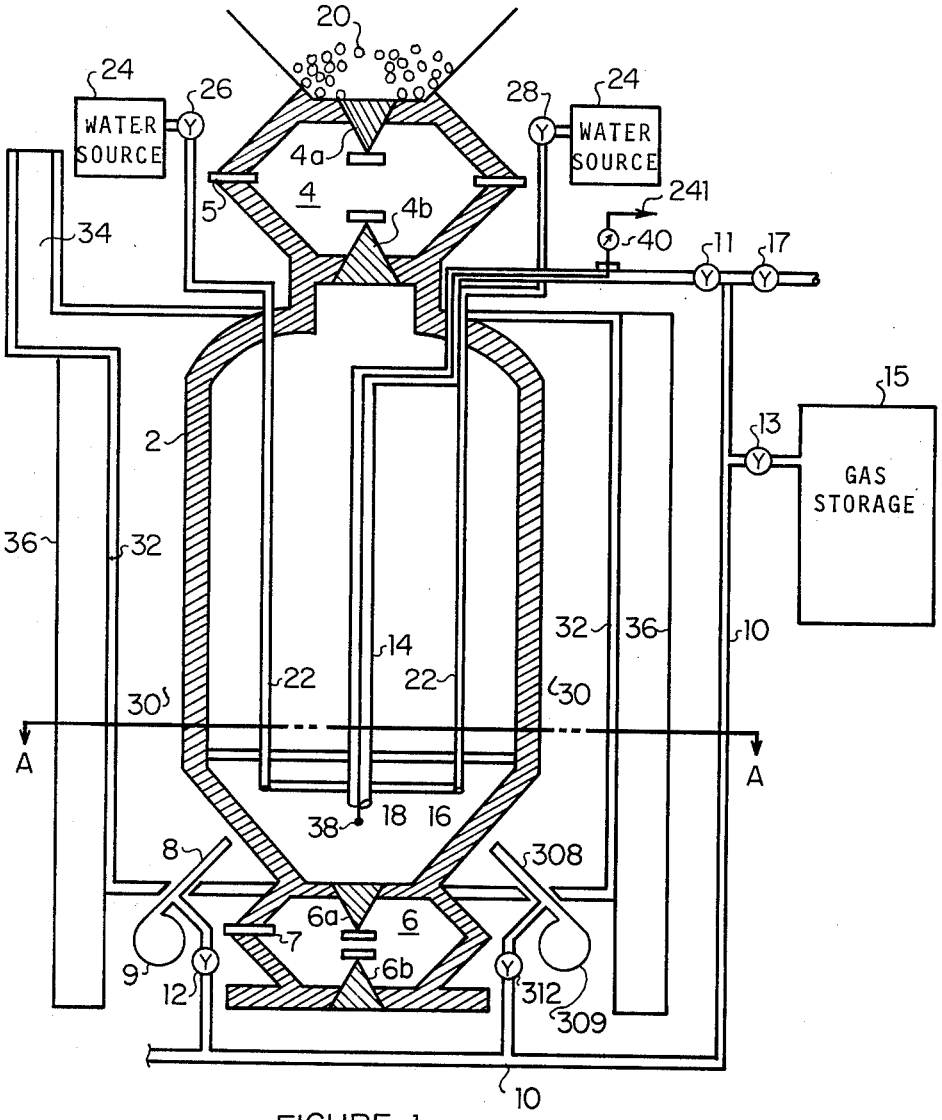
FIG. 1 is a sectional diagram of a self powered blue water gas generator made in accordance with the invention.
Figure 2:
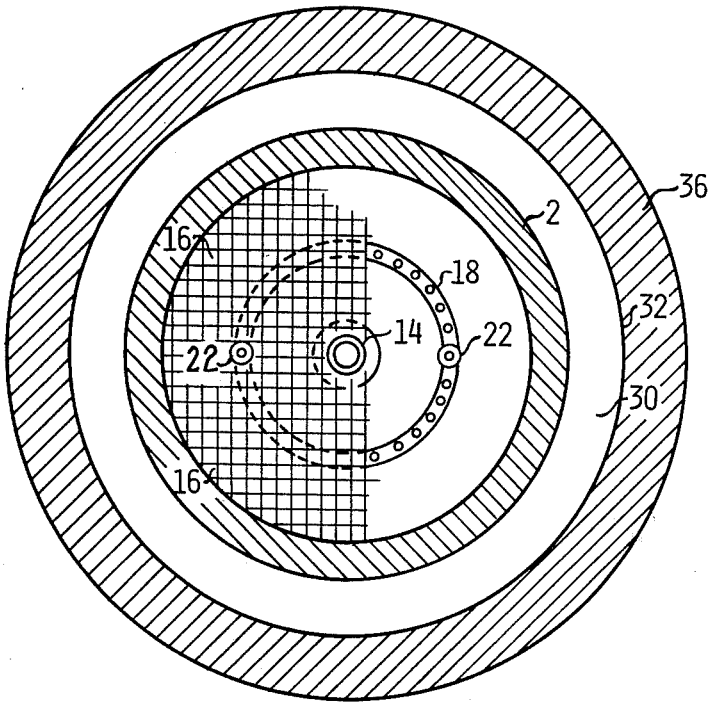
FIG. 2 is a sectional elevated view of the embodiment depicted in FIG. 1.

Referring to FIGS. 1 and 2, a gas generator is shown having a reflux chamber comprising a sealed retort forming a vertical column 2. Reflux chamber 2 has a raw material inlet air lock 4 and an outlet ash air lock 6 and is constructed of firebox steel such as A.S.T.M. 285-C or the like. Inlet air lock 4 and ash air lock 6 are each provided with vacuum extractors 5 and 7, respectively. Vacuum extractors 5 and 7 are coupled to a vacuum pump and activated in response to the air lock they are positioned within being opened for extracting poisonous gasses which may otherwise escape from reflux chamber 2 and for preventing any influx of oxygen. If, for example, carbonaceous material is to be fed through air lock 4, air lock 4 is evacuated by vacuum extractor 5 to extract any carbon monoxide, valve 4*a* is opened to receive carbonaceous material 20 within the air lock and valve 4*a* is again closed. Air lock 4 is again evacuated by vacuum extractor 5 to ensure a minimum oxygen gas intake and valve 4*b* is opened to pass the carbonaceous material to the interior of reflux chamber 2. Valve 4*b* is then closed and air lock 4 again evacuated. Air lock 6 and valves 6*a* and 6*b* are similarly operated to ensure minimum oxygen leakage into reflux chamber 2 and minimum carbon monoxide leakage out of reflux chamber 2. The gasses extracted are coupled by pipes and vacuum pumps (not depicted in FIG. 1) to burners 8 and 308. The extractors also assist inlet air lock 4 in receiving carbonaceous material and ash air lock 6 in passing ash produced by the generator.

The lower portion of the reflux chamber 2 is conically shaped and thermally coupled to burners 8 and 308 positioned to direct heat to the cone as straight as possible to produce maximum heating of reflux chamber 2. The cone shaped lower portion of the reflux chamber 2 provides thermal reradiation within the reflux chamber 2. Burner pipe 10 and valves 12 and 312 couple the burners 8 and 308 which are blower aspirated burners with attached air blowers 9 and 309 or the like to a water gas extractor pipe 14 positioned within reflux chamber 2. The water gas extractor pipe 14 extends below a reflux grate 16 and steam ring 18. Reflux grate 16 and steam ring 18 are each positioned within and thermally and structurally coupled to reflux chamber 2. The reflux grate 16 is positioned to receive carbonaceous material 20 which passes through input valve 4 and falls through the column formed by reflux chamber 2. Steam ring 18 is positioned below the grate 16 and is connected to water pipes 22 which provide water from an external water source 24 via valves 26 and 28. Referring to FIG. 2, a burner exhaust chamber 30 is formed by a shell 32 formed of A.S.T.M. A285C steel which surrounds reflux chamber 2. Exhaust chamber 30 captures combustion gasses produced by burners 8 and 308 and directs them to exhaust stack 34. Exhaust chamber 30 and shell 32 are surrounded by thermal insulation layers 36.

Reflux chamber 2 and grate 16 are elevated to a temperature of approximately 1190° C by externally heating reflux chamber 2 by combusting previously stored gas in gas storage 15 with burners 8 and 308. Valves 11 and 17 are closed and valves 12 and 13 opened and thermal energy produced is directed to the reflux chamber 2 to initially put the generator into operation. The preferred embodiment requires four burners to initially get reflux chamber 2 up to temperature and only one burner 8 is required to maintain the temperature during subsequent operation. Preferably, carbonaceous waste 20 is introduced through valve 4 after reflux chamber 2 and grate 16 have reached the operating temperature. Water is supplied from water source 24 in measured amounts as regulated by valves 26 and 28 to pipes 22 which supply steam ring 18. The water becomes steam during its passage through pipes 22 which are at a temperature well above the boiling point of water at the pressure existing within reflux chamber 2. The proper amount of water to add during operation is determined empirically and is dependent upon the type of carbonaceous waste utilized and its water content. If the carbonaceous waste is, for example, wood chips cut to approximately ½-inch cubes in size, the preferred amount is an equal weight amount of water for a given weight of wood chips. The observed ash resulting from this empirically derived amount is approximately 5% by weight of the input wood chips. Almost any carbonaceous material such as, for example, chipped plastics, filter carbon waste from dry cleaning industry, fruit pits, or the like is suitable carbonaceous material for the generator and the optimal amount of water to be added is easily determined empirically.

Referring to FIG. 1, control valve 11 is opened in response to gas generation within reflux chamber 2 as indicated by for example, a pressure gauge. Storage gas in gas storage 15 is replenished and valve 13 is closed. Water gas produced within reflux chamber 2 fuels burners 8 and 308 to self power the generator and excess water gas produced is available for utilization by adjusting valve 17 to supply an external process or storage. Burners 8 and 308 and blowers 9 and 309 are adjusted to maintain the temperature at the end of gas extractor pipe 14 at 1190° C as detected by thermocouple 38 and indicated by meter 40.

Continuous operation through continuous feeding and ash removal is possible due to air locks 4 and 6 and the indirect heating reflux process. It is not necessary to shut down the generator to place additional carbonaceous waste therein as air lock 4 maintains a substantial seal during feeding and air lock 6 maintains a substantial seal during ash removal. Burners 8 and 308 and blowers 9 and 309 are maintained or replaced without interrupting gas generation since they are positioned outside of reflux chamber 2 and are easily accessed without need for unsealing reflux chamber 2. If one burner needs to be replaced another burner is capable of maintaining the operating temperature during a replacement operation.

The embodiment depicted in FIG. 1 has a reflux chamber 2 having a height of 6 feet. Carbonaceous material such as wood chips sufficiently disperse by falling and refluxing within the chamber during feeding and operation. Other input carbonaceous fuel may require the inclusion of baffles or the like to ensure sufficient dispersion over grate 16. Grate 16 can also be made moveable and include shaking apparatus attached thereto.

Figure 3:
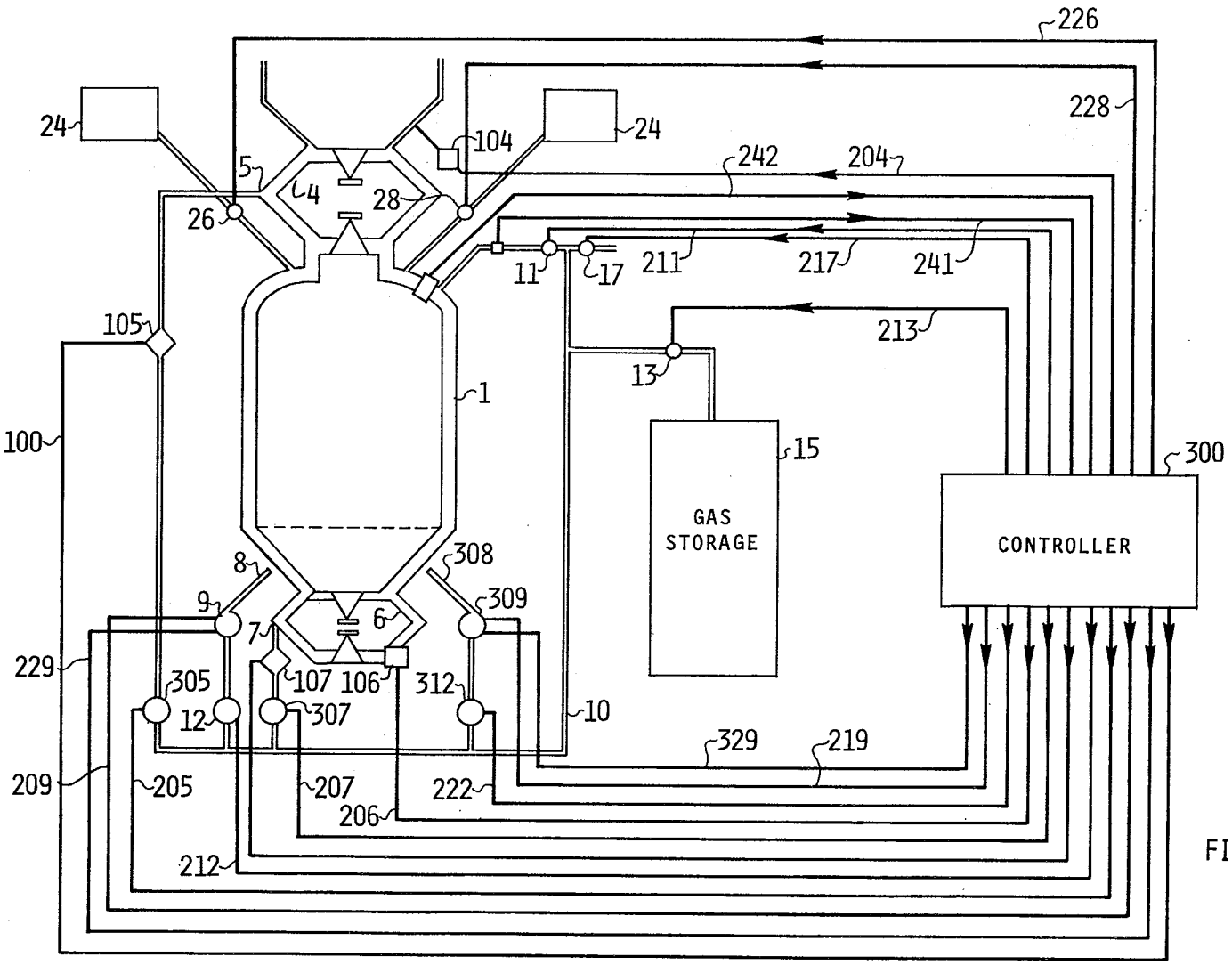
FIG. 3 is a schematic diagram of a control system for the generator of FIG. 1.

Referring to FIG. 3, there is shown a control system for generator 1. Input air lock 4 is opened in response to control signals 204 from controller 300. Controller 300 is a manually operated console, a specially programmed computer or the like. Control signals 204 actuate valve actuating means 104. Means 104 is an electrical solenoid operating fulcrums coupled to spring loaded valves, or the like. A controllable vacuum pump 105 coupled to vacuum extractor 5 is actuated in response to a signal 100 from controller 300. The rate, timing, and duration of vacuum is controlled and correlated with actuation of the valves of inlet air lock 4 by controller 300. Gas extracted by vacuum extractor 5 and vacuum pump 105 is passed by a valve 305 controlled by signal 205 to pipes supplying fuel to the burners. Similarly, during ash removal, air lock 6 is opened in response to signals 206 from controller 300 by valve actuating means 106. A controllable vacuum pump 107 sucks gasses from vacuum extractor 7 and supplies them via valve 307 to the burners 8 and 308.

Four burners (only two are shown in FIG. 3) are preferably used to bring the generator up to a desired temperature as discussed previously. The operating temperature is sensed by a thermocouple 38, shown in FIG. 1 which transmits a signal 241 corresponding to the temperature within reflux chamber 2. Controller 300 adjusts the heat applied to the generator 1 by controlling the amount of fuel to each burner, the air supplied to each burner, and the number of burners in operation. The amount of fuel is varied by valves 12 and 312 which are controlled by signals 212 and 222, respectively. The air supply to each burner is regulated by regulating the speed of blowers 9 and 309 with signals 209 and 219, respectively. The number of burners in operation are controlled for example by shutting off the fuel and air supply to a particular burner. A selected burner is brought into operation by supplying fuel to it and actuating an associated igniter. Each burner includes a controlled igniter, burner 8 having an igniter controlled by signal 229 and burner 308 having an igniter controlled by signal 329.

Measured amounts of water from source 24 are added by control valves 26 and 28 which are responsive to signals 226 and 228, respectively.

The flow of gas produced is routed to storage tank 15, an external load or the burners by valves 11, 17, and 13 which are responsive to signals 211, 217, and 213, respectively.

We claim:

1. A blue water gas generator comprising:

a sealed retort forming a vertical column and having an upper cylindrical portion and a lower inverse conically shaped portion, the upper and lower portions being separated by a grate which is thermally coupled to the retort and disposed within the retort in a substantially horizontal plane;

means coupled to the sealed retort for applying steam within the lower portion of the sealed retort;

burner means thermally coupled to the sealed retort and disposed outside of the sealed retort and below the grate for heating under reflux materials placed within the sealed retort and establishing a substantially vertical thermal gradient therein, the gradient having a higher temperature potential at the lower portion of the retort than at the upper portion;

an input air lock coupled to the upper portion of the retort and operatively disposed above the grate to receive carbonaceous materials and pass them onto the grate;

an output air lock coupled to the lower portion of the sealed retort and operatively disposed below the grate to receive material which passes through the grate; and gas extraction means coupled to the retort and communicating with the lower portion of the retort for receiving gas produced in the retort and being coupled to the burner means to burn a portion of the gas product.

2. A gas generator as in claim 1 comprising means thermally coupled to the sealed retort and coupled to the means for heating for regulating the temperature of the lower portion of the sealed retort about a selected temperature range.

3. A gas generator as in claim 1 wherein the input air lock comprises:

receiving valve means coupled to the sealed retort for receiving carbonaceous material and passing the carbonaceous material to the interior of the retort and for maintaining a substantial seal during said receiving and passing; and first vacuum extraction means coupled to the receiving valve means.

4. A gas generator as in claim 3 comprising means coupled to the first vacuum extraction means for combusting gas extracted from the receiving valve means.

5. A gas generator as in claim 4 comprising means coupled to the second vacuum extraction means for combusting gas extracted from the output valve means.

6. A gas generator as in claim 1 wherein the output air lock comprises:

output valve means coupled to the sealed retort for receiving ash produced by the gas generator and for maintaining a substantial seal during said receiving; and second vacuum extraction means coupled to the output valve means.

* * * * *